US009194276B2

(12) United States Patent
Wirt

(10) Patent No.: US 9,194,276 B2
(45) Date of Patent: Nov. 24, 2015

(54) EXHAUST ROUTERS

(71) Applicant: Dennis Wirt, Redmond, OR (US)

(72) Inventor: Dennis Wirt, Redmond, OR (US)

( * ) Notice: Subject to any disclaimer, the term of this patent is extended or adjusted under 35 U.S.C. 154(b) by 0 days.

(21) Appl. No.: 13/768,831

(22) Filed: Feb. 15, 2013

(65) Prior Publication Data

US 2014/0230406 A1 Aug. 21, 2014

(51) Int. Cl.

| | |
|---|---|
| ***F02B 27/04*** | (2006.01) |
| ***F01N 1/00*** | (2006.01) |
| ***F01N 13/08*** | (2010.01) |

(52) U.S. Cl.

CPC ..... *F01N 13/087* (2013.01)

(58) Field of Classification Search

CPC ... F01N 13/1805; F01N 13/087; F01N 1/166; F01N 2390/08; F01N 2410/10; F01N 181/236

USPC ..... 3/324; 181/236

See application file for complete search history.

(56) References Cited

U.S. PATENT DOCUMENTS

| | | | | |
|---|---|---|---|---|
| 1,447,380 | A | 3/1923 | Goetz | |
| 1,628,738 | A * | 5/1927 | Olness | 251/148 |
| 3,367,311 | A * | 2/1968 | Tenney | 123/65 E |
| 4,494,564 | A * | 1/1985 | Lukacz | 137/527.6 |
| 4,779,705 | A | 10/1988 | Verdin | |
| 5,452,578 | A * | 9/1995 | Barber | 60/324 |
| 5,959,263 | A | 9/1999 | Foltz, Jr. | |
| 6,584,767 | B1 * | 7/2003 | Koenig | 60/288 |
| 6,662,554 | B2 | 12/2003 | Sheidler et al. | |
| 6,955,188 | B2 * | 10/2005 | Heckt | 137/875 |
| 7,686,130 | B1 | 3/2010 | Quaglia | |
| 7,748,213 | B2 | 7/2010 | Sato et al. | |
| 7,802,424 | B2 * | 9/2010 | Kanzawa et al. | 60/324 |
| 2010/0146957 | A1 * | 6/2010 | Ambrosino et al. | 60/324 |
| 2011/0005890 | A1 * | 1/2011 | Volz et al. | 192/218 |
| 2011/0225960 | A1 * | 9/2011 | Kanzaki et al. | 60/317 |

OTHER PUBLICATIONS

Stephen Anderson, "Zoomie Deuce," Jun. 2004, Street Rod Builder Magazine, Cover and p. 62.*

Electric Exhaust Cutouts Brochure, www.dmhperformance.com.

Davis Motorsports of Reno, Professional Auto Racings General Store, Zoomie Roadster Cutouts, www.shop.davismotorsportsofreno.com.

* cited by examiner

*Primary Examiner* — Kenneth Bomberg
*Assistant Examiner* — Jason Sheppard
(74) *Attorney, Agent, or Firm* — Leber Patent Law P.C.

(57) ABSTRACT

Exhaust routing devices are disclosed that include (a) a body defining an exhaust routing chamber, the body having an intake port configured to provide fluid communication between the exhaust port of a cylinder head and the chamber, and two outlet ports configured to provide fluid communication between the chamber and first and second exhaust pipes; and (b) a gate, mounted within the chamber to pivot between a first position, in which the gate occludes one of the outlet ports, and a second position, in which the gate occludes the other outlet port. Exhaust routing systems and method of using them are also disclosed.

15 Claims, 7 Drawing Sheets

EXHAUST ROUTERS

BACKGROUND

Auto enthusiasts have long produced cars known as "hot rods" by modifying the engines of American cars to increase their speed and acceleration. Hot rods used in drag racing generally have open headers, i.e., individual exhaust pipes that run directly from the engine to the atmosphere without a muffler, often referred to as "zoomies." While this type of exhaust system provides optimal performance, due to the minimization of backpressure, the lack of a muffler generally makes such exhaust systems unacceptably loud for street use. Many hot rod owners would like their vehicles to be "street legal," i.e., in compliance with noise and emission laws and ordinances, while still having the option of open zoomies for use at the drag strip.

SUMMARY

The exhaust routers disclosed herein allow a user to easily route exhaust from the exhaust port of each cylinder of an internal combustion engine between a first route (e.g., a header pipe to a muffler system or an exhaust pipe including a standard muffler) and a second route (e.g., an open exhaust pipe such as a zoomie.) A separate exhaust router is provided for each exhaust pipe, allowing routing of the exhaust from each exhaust port, with routing occurring right at the exhaust port in preferred implementations. Positioning the router at the exhaust port, rather than downstream in the zoomie, avoids undesirable turbulence. In some implementations, the user can adjust backpressure and noise to desired levels by routing the exhaust in only selected, individual routers through the zoomies, with exhaust from other cylinders being routed through a muffler system.

In one aspect, the invention features an exhaust routing device comprising: (a) a body defining an exhaust routing chamber, the body having an intake port configured to provide fluid communication between the exhaust port of an internal combustion engine and the chamber, and two outlet ports configured to provide fluid communication between the chamber and first and second exhaust pipes; and (b) a gate, mounted within the chamber to pivot between a first position, in which the gate occludes one of the outlet ports, and a second position, in which the gate occludes the other outlet port.

Some implementations may include one or more of the following features. The device may also include an overtravel spring assembly that is configured to bias the gate toward the first position. In such implementations, the gate is preferably mounted on a shaft in a keyed engagement with sufficient clearance between keyed surfaces to allow the shaft to continue to rotate after the gate comes to rest in the first position. The combination of the biasing action of the spring and the clearance between the keyed features allows multiple routers mounted on a common shaft to all move into a closed, sealed first position even if one of the gates is misaligned, e.g., due to carbon build-up. The clearance may, for example, be sufficient to allow at least 5 degrees of rotation of the shaft after the gate comes to rest. In some cases the clearance is selected to allow from about 5 to 10 degrees of rotation, e.g., 7 degrees.

In some cases, the gate has surfaces that are configured for sealing engagement with a seat portion of the body. For example, the gate may have arcuate and chamfered surfaces configured, e.g., by machining, to sealingly engage corresponding surfaces of the seat portion.

As noted above, the gate may be mounted on a shaft in a keyed engagement. For example, the gate may be mounted on a splined shaft, for example a hexagonal shaft, or on a round shaft with a keying feature, e.g., a groove on the shaft that engages a ridge on the gate.

In another aspect, the invention features an exhaust routing system that includes a plurality of such exhaust routing devices, one mounted at each exhaust port of an internal combustion engine.

In a further aspect, the invention features a method of routing exhaust from an internal combustion engine. The method includes rotating the gates of a plurality of exhaust routing devices between a first position, in which the exhaust takes a first route, and a second position, in which the exhaust takes a second, different route. Each exhaust routing device has the features discussed above and is mounted at an exhaust port of a cylinder of the engine.

In some implementations, the first route is through a muffled exhaust pipe, for example a header pipe to a muffler system or an exhaust pipe including a standard muffler, and the second route is through an open exhaust pipe such as a zoomie. All of the exhaust routing devices may be rotated substantially simultaneously, or the devices may be rotated selectively. In some cases, all of the exhaust routing devices on one side of the engine are rotated together by a common shaft that extends through each of the routers.

DETAILED DESCRIPTION

Figure 1:
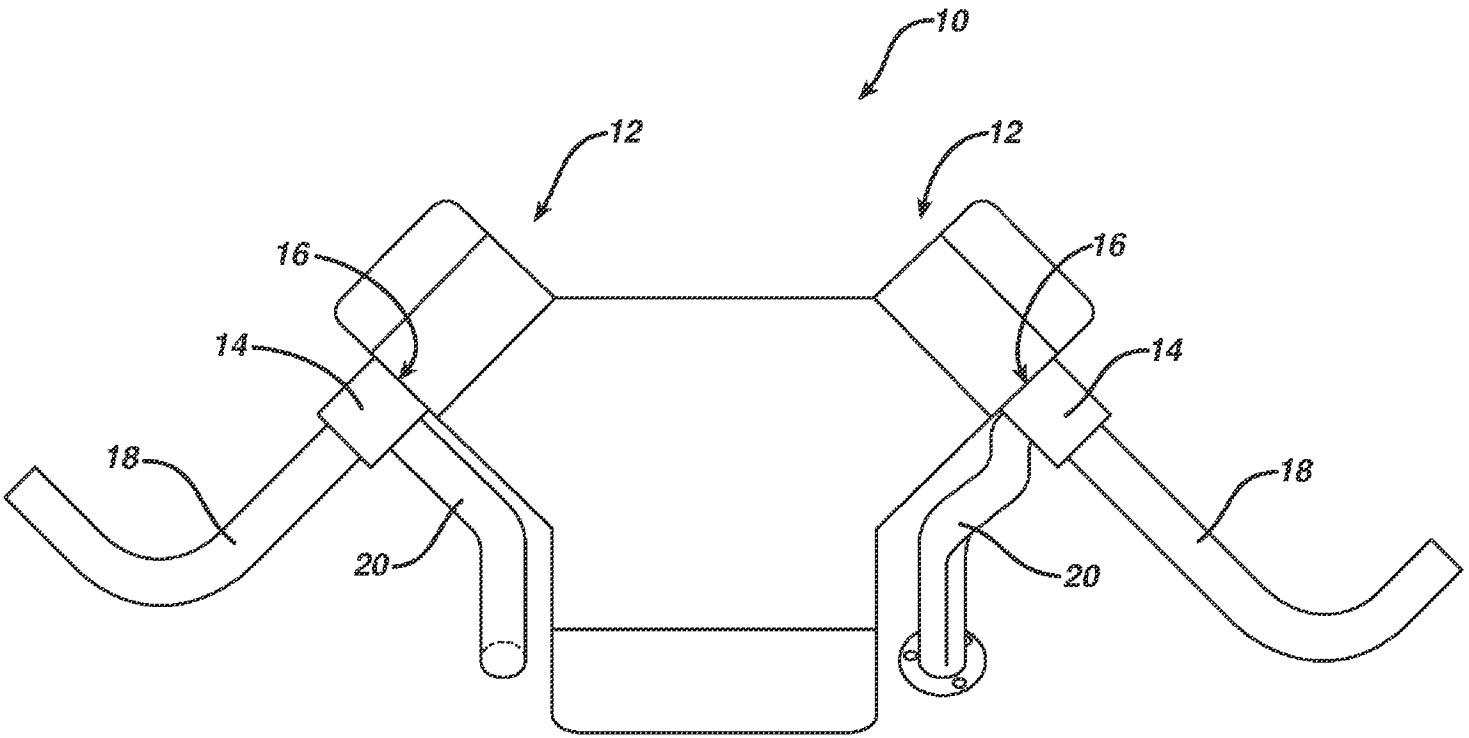
FIG. 1 is a simplified diagrammatic view of an engine with an exhaust routing system according to one implementation.
Figure 2:
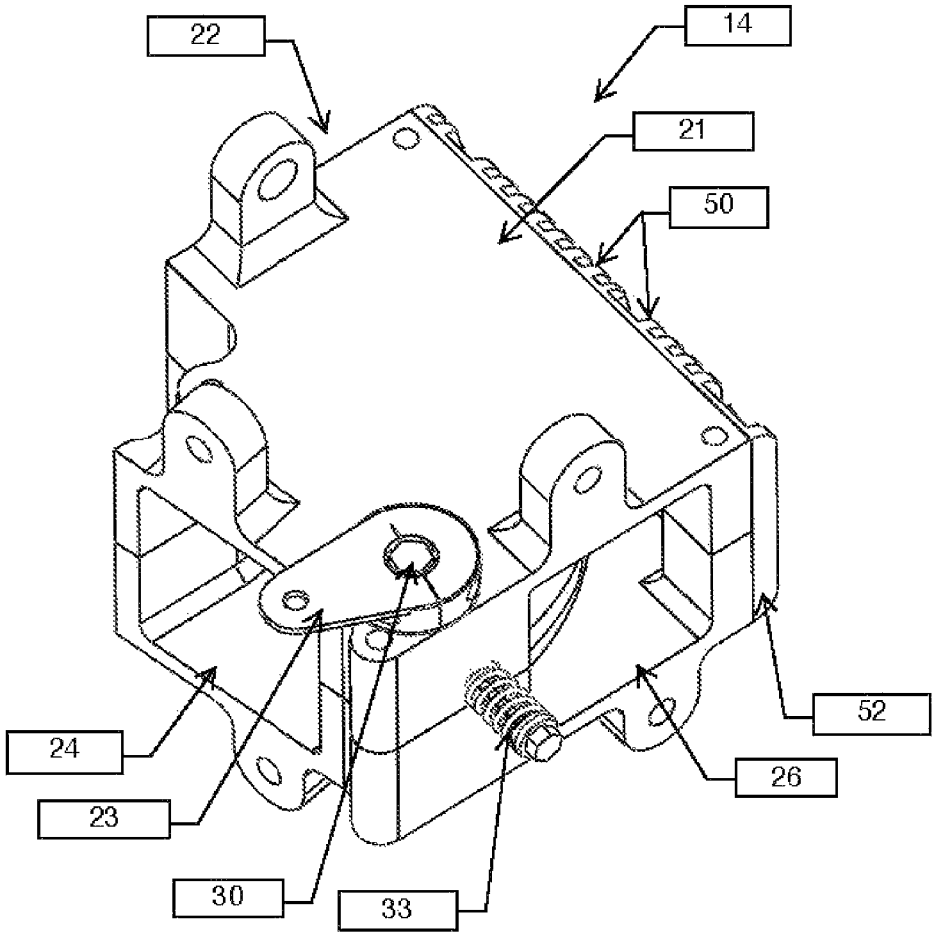
FIG. 2 is a perspective view of an exhaust router according to one embodiment.

FIG. 1 shows an engine 10 having a plurality of cylinders 12. Each cylinder 12 has an exhaust router 14 mounted at its exhaust port 16. Each exhaust router device 14 is in fluid communication with the exhaust port and with a zoomie 18 and a header pipe 20 that sends the exhaust to a muffler system, e.g., a collector and common muffler (not shown).

The exhaust router 14, shown in detail in FIGS. 2-4A, includes a body 21 which defines an intake port 22 that is configured for fluid communication with the exhaust port of the cylinder to which it is mounted, e.g., by bolting. Body 21 also defines a first outlet 24, the axis of which is disposed generally at a right angle to that of the intake port 22, and a second outlet port 26, the axis of which is disposed generally parallel to or collinear with that of the intake port 22. Each of the outlet ports is connected to an exhaust pipe. In the embodiment shown in FIG. 1, the header pipe 20 would be connected to outlet port 24 and the zoomie 18 would be connected to outlet port 26.

Figure 3:
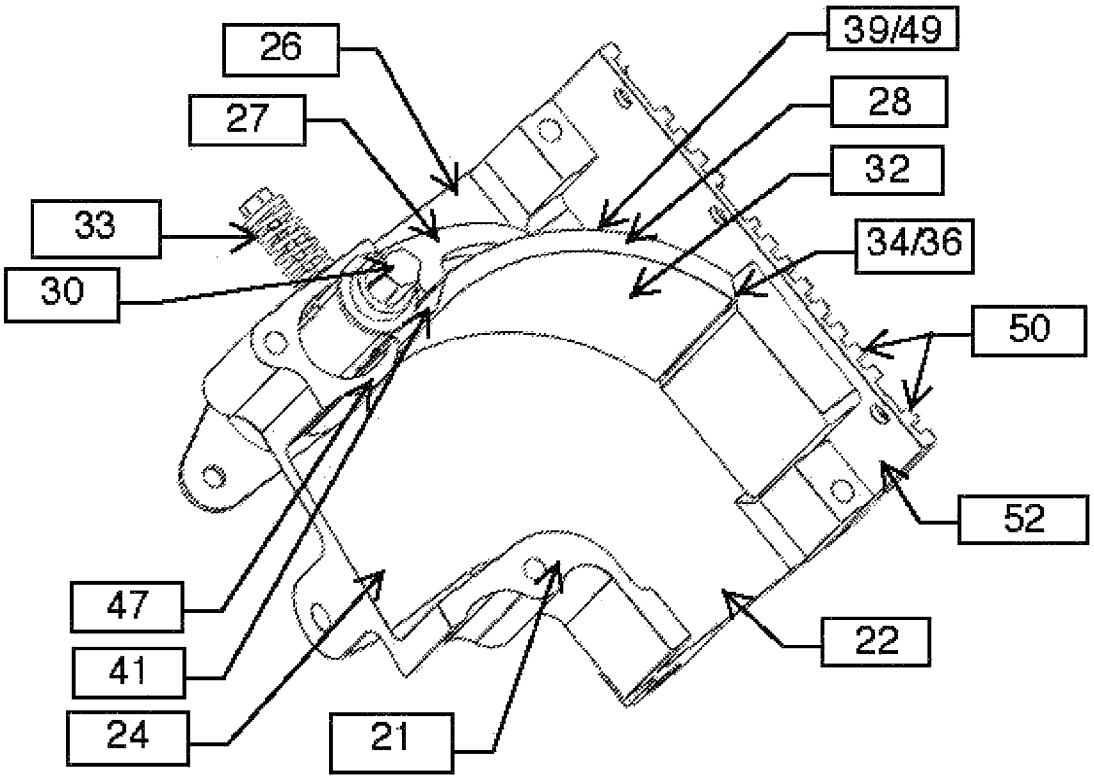
FIGS. 3 and 3A are perspective and top views, respectively, of the exhaust router shown in FIG. 2 with the upper portion removed and the gate in a first position.
Figure 3A:
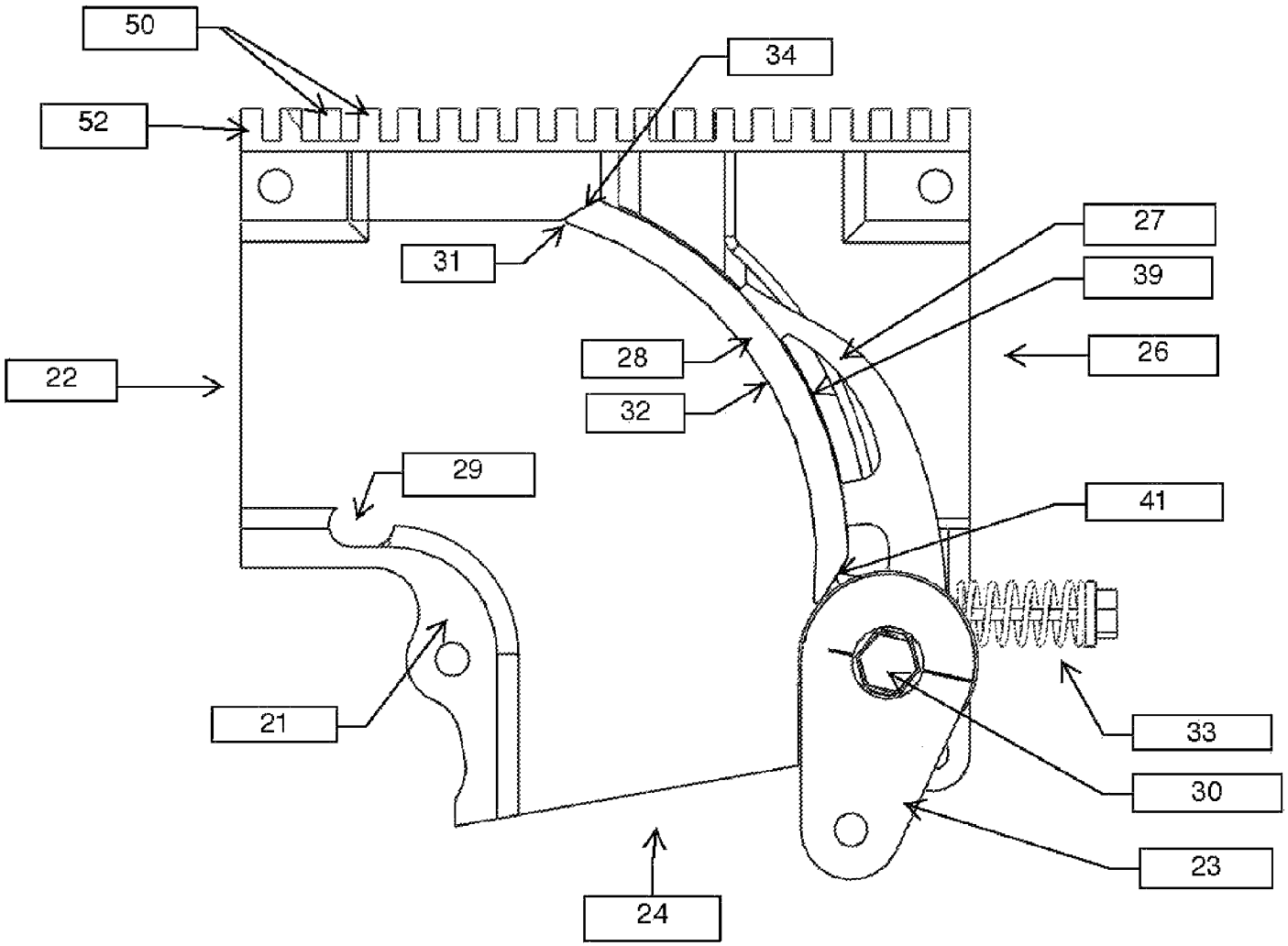
Figure 4:
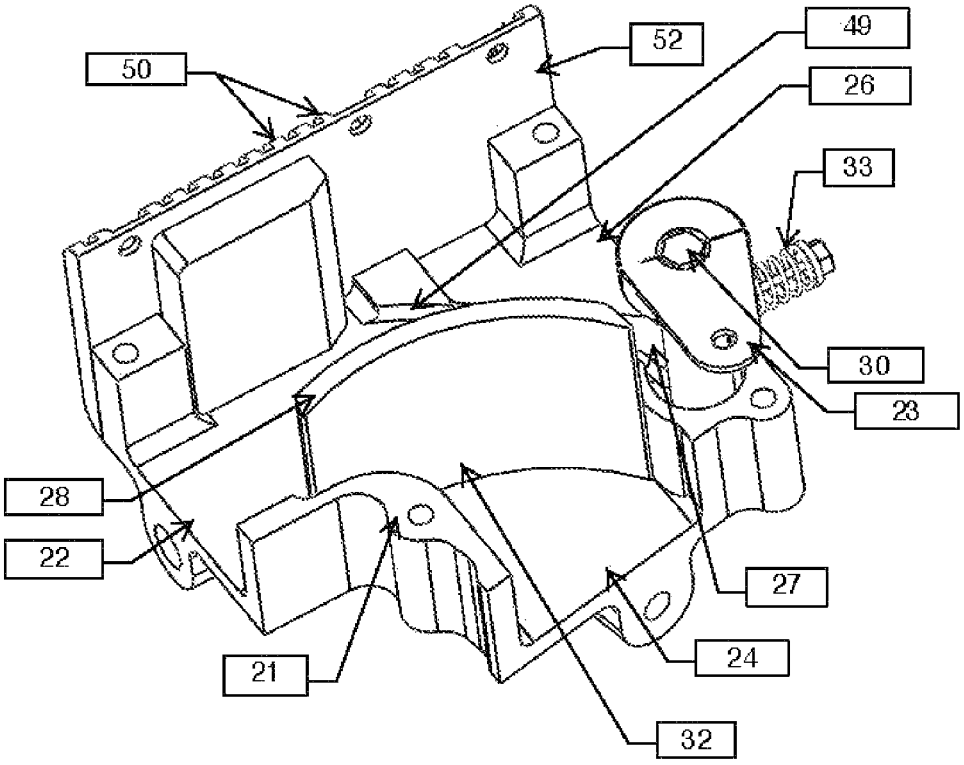
FIGS. 4 and 4A are perspective and top views, respectively, of the exhaust router shown in FIG. 2 with the upper portion removed and the gate in a second position.
Figure 4A:
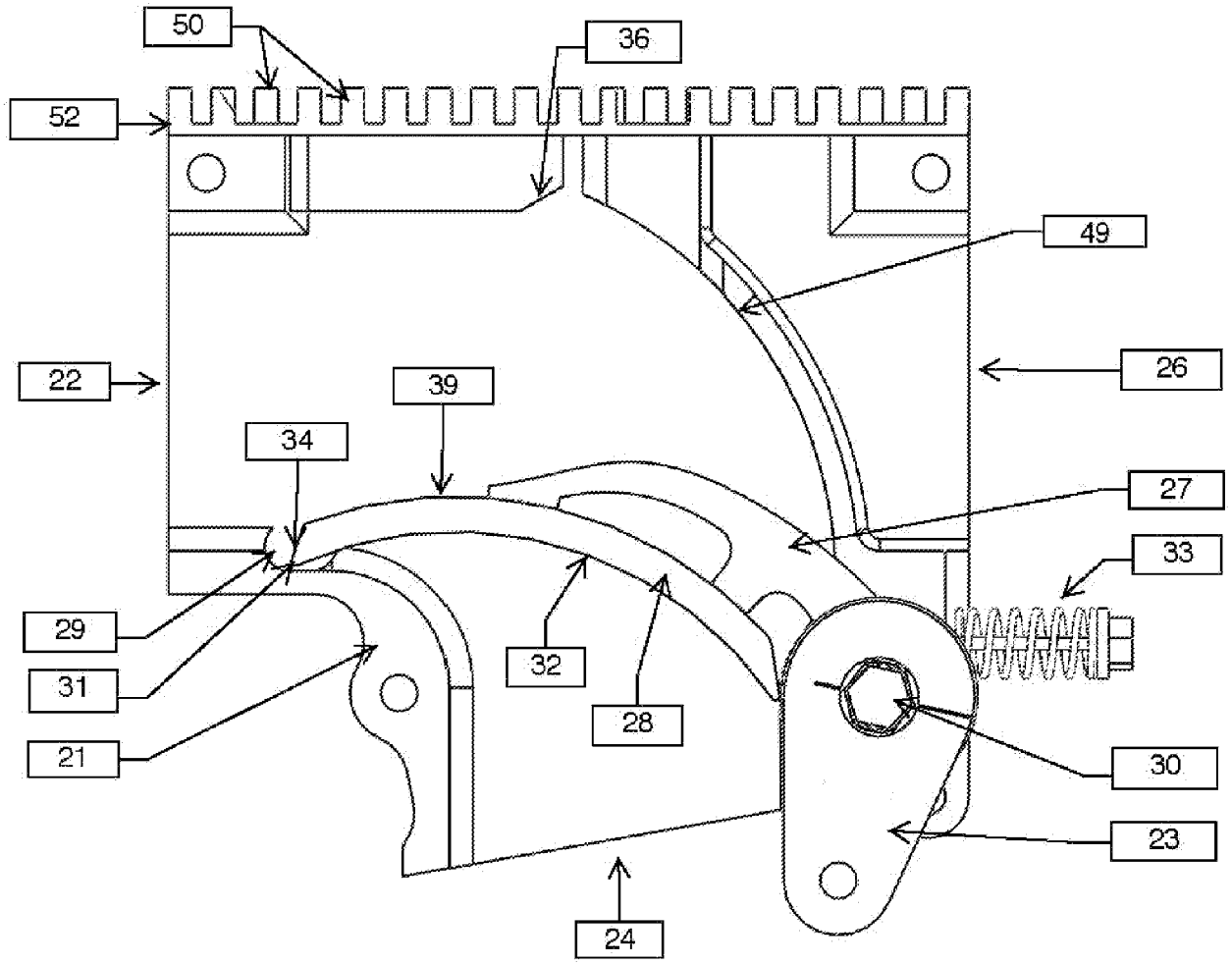
Figure 5:
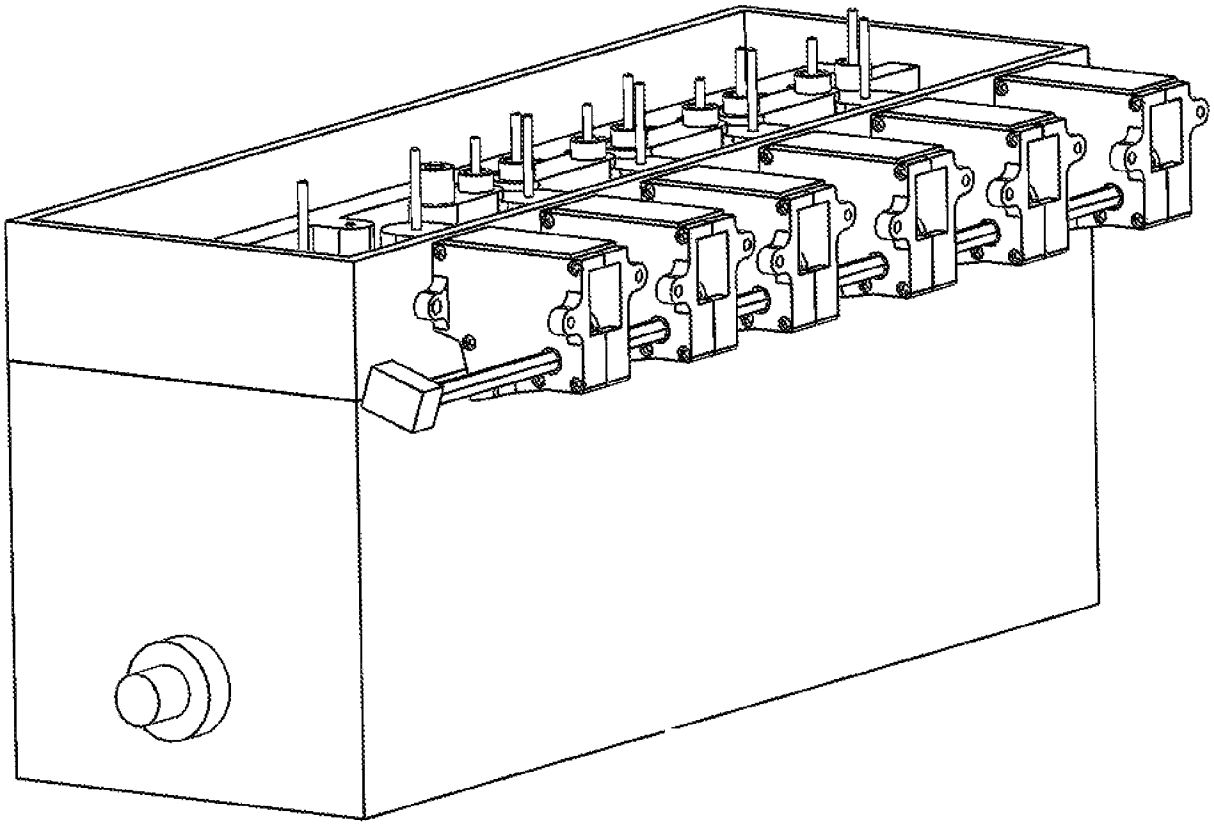
FIG. 5 is a diagrammatic view showing multiple discrete exhaust routing devices mounted at the exhaust ports of the cylinders of an engine.

A gate 28 is mounted on a shaft 30 to pivot about a pivot axis that is generally perpendicular to the axes of the ports between a first position, shown in FIGS. 3-3A, in which port 24 is open and port 26 is sealed off, and a second position, shown in FIGS. 4-4A, in which port 24 is occluded and port 26 is open. Thus, in the embodiment shown in FIG. 1, when the gate is in the first position exhaust would be flowing to the header pipe 20 and the zoomie would be sealed off, while when the gate is in the second position exhaust would be routed to the zoomie 18 and the header pipe 20 would be closed.

When the gate is in each of its positions, under normal circumstances the occluded port is completely closed off, and in the case of the first position (FIGS. 3-3A) the gate seals against the body 21, as will be discussed below, to prevent any flow of exhaust into the zoomie. This sealing of the zoomie is important in order to prevent the noise that is caused by flow of exhaust into the zoomie.

Sealing between the gate and the port is provided by intimate contact between surfaces of the gate and mating seat surfaces of the body 21. Thus, the gate has an arcuate surface 32 on one side, a corresponding arcuate surface 39 on the other side, a chamfered surface 34 at one end, and a chamfered end surface 41 at the other end. When the gate 28 is in the first position (FIG. 3A), the chamfered end surface 34 of the gate sealingly contacts the corresponding chamfered surface 36 of the body, and the chamfered surface 41 contacts a corresponding chamfered surface (not shown) at the edge of portion 47 of the body (FIG. 3). The arcuate surface 39 contacts a seat portion 49 of the body 21, as best seen in FIG. 3. These mating surfaces may be formed in any manner that provides high tolerances for intimate contact, for example by precision machining.

A seal is also provided when the gate is in the second position, although this seal is not necessarily fluid-tight, since there is a less stringent requirement to prevent flow of exhaust into the header pipe 20 when the zoomie 18 is in use. In this case, the body defines a groove 29 (FIGS. 3A and 4A), which receives the arcuate surface 32 and the edge 31 of gate 28 in sealing engagement when the gate is in the second position (FIG. 4A) in which the header pipe 20 is blocked by the gate.

The gate 28 is mounted on the shaft 30 in a keyed engagement, such that rotation of the shaft pivots the gate. This keyed engagement may be provided by a splined shaft, e.g., having a hexagonal cross-section as shown or any other desired cross-section. In this case the gate arm 27 has a correspondingly shaped opening (not shown) in which the shaft is positioned. Alternatively, other keyed arrangements may be used, for example a round shaft having a key way, e.g., a longitudinal groove, and a corresponding key structure on the gate, e.g., a longitudinal ridge configured to be received by the groove. Bushings (not shown) are provided on either side of the gate for sealing. An actuator arm 23 (FIGS. 3A and 4A) is provided to allow a lever (not shown) to be used to rotate that shaft.

The multiple exhaust routers that are mounted on the individual cylinders of an engine can be connected so that all of the gates can be pivoted at once. For example, the routers on one side of the engine can be connected by a common shaft (shaft 30) such that all of their gates pivot together when the shaft is rotated.

A small clearance is provided between the shaft and the keyed feature(s) of the receiving opening in the gate arm 27 to allow some slack between the rotation of the shaft and the pivoting of the gate. This clearance is configured to allow rotational movement of the shaft to continue after the gate has contacted the seat as shown in FIG. 3A. This movement is facilitated by an overtravel spring assembly 33 (best seen in FIG. 4), which pulls the gate towards the position shown in FIG. 3A. The clearance and overtravel spring assembly are provided to allow for misalignment between individual routers that are mounted on a common shaft, e.g., due to carbon build-up on one of the routers that causes the gate of that router to seat before the other gates. If this occurs, the spring assemblies of the other routers will continue to pull those gates toward their seated, sealed positions, and the necessary continued rotation of the shaft will be allowed by the clearance. In some implementations, the clearance is selected to be sufficient to provide at least 5 degrees of rotational movement of the shaft after the gate has seated, for example about 5-10 degrees, e.g., about 7 degrees.

The body 21 may include cooling fins 50, as shown, to dissipate heat which could otherwise build up and transfer to the engine. Also, the body 21 is preferably formed in two halves, as shown, with an end cap 52 that is removable for servicing of the router, e.g., removal of carbon build-up or other contamination.

OTHER EMBODIMENTS

A number of embodiments have been described. Nevertheless, it will be understood that various modifications may be made without departing from the spirit and scope of the disclosure.

For example, movement of the gate may be actuated in other ways, for example using an automatic actuator. Moreover, size and or shape of the router and its components may be different from what is shown in the drawings, for example to adapt the router to use in different makes of engines.

Accordingly, other embodiments are within the scope of the following claims.

What is claimed is:

1. An exhaust routing system comprising:

an engine having a plurality of cylinders, mounted at the exhaust port of each cylinder of the engine, an exhaust routing device, each routing device including:

a body defining an exhaust routing chamber having an intake port configured to be mounted in fluid communication with the exhaust port of the engine, a first outlet port configured to provide fluid communication between the chamber and a zoomie, and a second outlet port configured to provide fluid communication between the chamber and a header pipe to a muffler system, the body including a chamfered seat portion; and a gate, mounted within the chamber to pivot between a first position, in which the gate occludes the first outlet port and a second position, in which the gate occludes the second outlet port, the gate having an arcuate surface and including a chamfered portion which seals against the chamfered portion of the body when the gate is in the first position, and a zoomie mounted at the first outlet port of each exhaust routing device.

2. The system of claim 1 wherein each exhaust routing device further comprises an overtravel spring assembly configured to bias the gate toward the first position.

3. The system of claim 2 wherein the gate is mounted on a shaft in a keyed engagement.

4. The system of claim 1 wherein the arcuate surface is contacted by exhaust gas when the gate is in the first position.

5. The system of claim 1 wherein the chamfered surfaces of the gate and seat are formed by machining.

6. The system of claim 1 further comprising a shaft on which the gate is mounted in a keyed engagement and which is configured to pivot the gate between the first and second positions.

7. The system of claim 1 further comprising a header pipe mounted at the second outlet port.

8. The system of claim 1 wherein the gate forms a substantially fluidtight seal with the body when the gate is in the first position.

9. A method of routing exhaust from an internal combustion engine, the method comprising:

mounting an exhaust routing device at the exhaust port of each cylinder of the engine; and rotating a gate of each exhaust routing device between a first position, in which the exhaust takes a first route, through a header pipe to a muffler, and a second position, in which the exhaust takes a second route, through a zoomie, each exhaust routing device comprising:

(a) a body defining an exhaust routing chamber, the body having an intake port configured to be mounted at the exhaust port of the engine and provide fluid communication between the exhaust port and the chamber, a first outlet port configured to provide fluid communication between the chamber and the zoomie and a second outlet port configured to provide fluid communication between the chamber and a header pipe to a muffler system, the body including a chamfered seat portion;

wherein the zoomie is mounted at the first outlet port; and (b) the gate, which is mounted within the chamber to pivot between a first position, in which the gate occludes the first outlet port, and a second position, in which the gate occludes the second outlet port, the gate having an arcuate surface and including a chamfered portion which seals against the chamfered portion of the body when the gate is in the first position.

10. The system of claim 1 wherein the chamfered surfaces are in intimate contact when the gate is in the first position.

11. The system of claim 1 wherein a longitudinal axis of the second outlet port is perpendicular to a longitudinal axis of the intake port.

12. The system of claim 11 wherein a longitudinal axis of the first outlet port is parallel to or collinear with the longitudinal axis of the intake port.

13. The system of claim 1 wherein the body further comprises cooling fins to dissipate heat from the body.

14. The method of claim 9 further comprising utilizing cooling fins on the body to dissipate heat from the body.

15. The method of claim 9 further comprising biasing the gates towards the first position.

* * * * *